United States Patent [19]

Polan

[11] Patent Number: 4,957,169

[45] Date of Patent: Sep. 18, 1990

[54] SPRINKLER VALVE ASSEMBLY

[75] Inventor: George S. Polan, Harleysville, Pa.

[73] Assignee: Central Sprinkler Corporation, Lansdale, Pa.

[21] Appl. No.: 475,629

[22] Filed: Feb. 6, 1990

Related U.S. Application Data

[63] Continuation-in-part of Ser. No. 307,557, Feb. 1, 1989, abandoned.

[51] Int. Cl.[5] ..... A62C 37/12

[52] U.S. Cl. ..... 169/37; 169/38

[58] Field of Search ..... 169/22, 37, 38, 39, 169/40, 41, 90

[56] References Cited

U.S. PATENT DOCUMENTS

| | | | |
|---|---|---|---|
| 428,053 | 5/1890 | Nagle . | |
| 1,038,958 | 9/1912 | Quick . | |
| 1,169,018 | 1/1916 | Duley . | |
| 1,392,593 | 10/1921 | Newton . | |
| 1,432,386 | 10/1922 | Curney . | |
| 1,502,187 | 7/1924 | Gronros . | |
| 2,125,510 | 8/1938 | Lewis | 169/38 |
| 2,165,477 | 7/1939 | Griffith . | |
| 2,245,144 | 6/1941 | Griffith . | |
| 2,534,066 | 12/1950 | Rowley . | |
| 2,664,956 | 1/1954 | Barz . | |
| 3,007,528 | 11/1961 | Gloeckler . | |
| 3,584,689 | 6/1971 | Willms . | |
| 3,797,746 | 3/1974 | Gray | 169/37 |
| 3,811,511 | 5/1974 | McCulloch | 169/41 |
| 4,014,388 | 3/1977 | Anderson | 169/37 |
| 4,660,645 | 4/1987 | Zen | 169/37 |

FOREIGN PATENT DOCUMENTS

| | | |
|---|---|---|
| 1065276 | 9/1959 | Fed. Rep. of Germany . |
| 2225215 | 10/1972 | Fed. Rep. of Germany . |
| 333412 | 9/1930 | United Kingdom . |
| 1359857 | 7/1974 | United Kingdom . |

*Primary Examiner*—Sherman Basinger
*Assistant Examiner*—Stephen P. Avila
*Attorney, Agent, or Firm*—Panitch Schwarze Jacobs & Nadel

[57] ABSTRACT

A sprinkler valve assembly comprising a single thermal responsive element and two or more support pins arranged with respect to a central axis so that the thermal responsive element is supported under axial compressive load substantially without thermal obtrusion by said support pins at substantially all orientations of the assembly with respect to its central axis.

13 Claims, 2 Drawing Sheets

SPRINKLER VALVE ASSEMBLY

RELATED APPLICATION

This is a continuation-in-part application of U.S. Pat. Application Ser. No. 307,557, filed Feb. 1, 1989, now abandoned.

FIELD OF THE INVENTION

The invention is directed to the field of automatic fire sprinkler equipment and quick response sprinklers in particular.

BACKGROUND OF THE INVENTION

Quick response sprinklers utilizing frangible bulbs as the thermal responsive element are well-known. Typically, the thermal responsive element is mounted between the valve plug and an adjustment screw so as to axially pre-load the valve plug in sealing engagement with the outlet of the sprinkler body flow passage, and the axial (compressive) load on the frangible bulb is the same as the axial pre-load on the valve plug. In general, the response time of the sprinkler is directly proportional to the thickness of the bulb wall which, in turn, is directly proportional to the amount of axial load which the bulb must bear without breaking.

The axial load exerted on the bulb may be reduced, while retaining the desired pre-load on the valve plug, by distributing the axial load between the bulb and a support element also disposed between the adjustment screw and valve plug. The support element, however, may degrade performance of the thermal responsive element due to placement of the support element relative to the thermal responsive element. Thus, a stream of ambient air to be sensed by the thermal responsive element may impinge on the sprinkler at a particular angle. Depending on the angular orientation of the bulb and support element with respect to the sprinkler central axis, the bulb may be fully exposed to the stream of air or it may be partially or fully blocked from the stream by the support element. Although the bulb and support element may be initially configured to fully expose the bulb to the ambient stream of air when the sprinkler is first installed, vibration may cause the angular orientation of the valve assembly to shift so that the support element thermally blocks the bulb from the ambient air stream. Thermal obtrusion of the bulb by the support element, as heretofore described, is clearly undesirable as the thermal responsive element may fail to rupture at elevated air stream temperatures.

Various valve assembly configurations have been proposed either to distribute the axial preload or to introduce redundancy in the thermal responsive element. For example, German A.S. No. 1,065,276 discloses a sprinkler wherein at least two frangible bulbs and a metal peg are arranged in a triangular pattern between a pair of plates interposed between the adjustment screw and the valve plug. At least two frangible bulbs are required so that at least one will rupture (should the other fail) to release the valve plug at a predetermined elevated temperature.

U.S. Pat. No. 2,125,510 discloses an automatic sprinkler wherein the valve assembly includes a frangible bulb nested in a collapsible strut assembly. The axial load is equally distributed between the bulb and strut assembly.

U.K. patent No. 1,359,857 discloses an automatic sprinkler wherein the valve assembly includes a pair of thermal responsive elements, namely, a frangible bulb and a strut and explosive charge.

The problem solved by the present invention is that of reducing the axial load on the frangible bulb, whereby thinner walled, more lightweight and quicker acting bulbs may be utilized, without thermal obtrusion of the bulb by the support element at all angular orientations of the valve assembly with respect to its central axis.

SUMMARY OF THE INVENTION

Sprinkler including a body having a flow passage for a fire extinguishing fluid and a valve assembly axially loaded by an adjustable screw or the like to seal the flow passage. The valve assembly comprises a plate, a valve plug seated at an outlet end of the flow passage, and a single thermal responsive element and two or more support pins extending between and seated at opposite ends thereof in the plate and valve plug. The thermal responsive element and support pins are spaced apart so as to support the plate under axial load substantially without thermal obtrusion of the thermal responsive element by the support pins at substantially all angular orientations of the valve assembly with respect to a central axis of the assembly.

The plate may be generally T-shaped having three or more recesses, each disposed at an extremity of the plate. The valve plug may have three or more recesses disposed in substantially the same or a different pattern as the plate recesses. The thermal responsive element and support pins are seated at opposite ends thereof in the plate and valve plug recesses.

The axial load on the thermal responsive element is no greater than substantially equal to the axial load on the plate divided by the number of support pins plus one.

A resilient compressive seal may be axially interposed between a portion of the valve plug and a portion of the sprinkler body at the flow passage outlet to cushion the valve plug against pressure surges.

For the purpose of illustrating the invention, there is shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
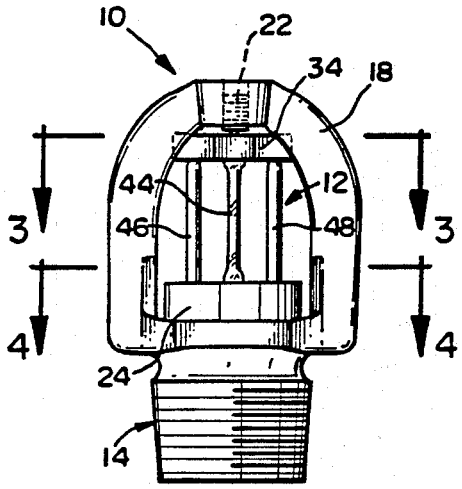
FIG. 1 is a side elevation of a sprinkler having a valve assembly according to the present invention.
Figure 2:
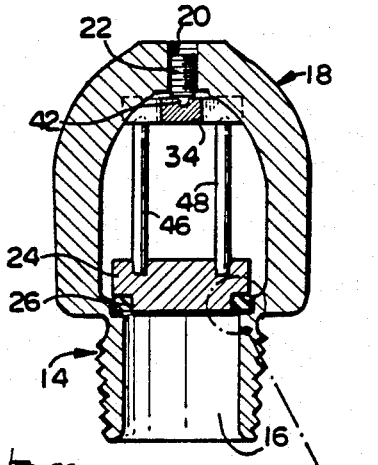
FIG. 2 is a section of the sprinkler in FIG. 1.

Referring to the drawings, wherein like numerals indicate like elements, there is shown in FIG. 1 a sprinkler 10 incorporating a valve assembly 12 according to the present invention. Sprinkler 10 includes a body 14 defining a flow passage 16. The sprinkler body also includes a yoke 18 having threaded passage 20 for receiving a load adjustment screw 22. The valve assembly 12 includes a valve plug 24 in the shape of a disc having an annular undercut which receives a resilient compressive seal in the form of an O-ring 26. The sprinkler body is cut out to form an annular shoulder on which the O-ring is seated. The annular shoulder is preferably beveled in a radially outwardly extending direction, as illustrated in the enlarged portion of FIG. 2. Thus, the O-ring is disposed axially between the plug and sprinkler body so as to seal the flow passage outlet while cushioning the valve plug from pressure surges of the fire extinguishing fluid.

Figure 4:
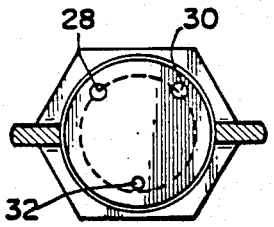
FIG. 4 is a section taken along 4—4 in FIG. 1.

Three recesses 28, 30, 32 are drilled in the valve plug. The recesses may be spaced equidistant along an imaginary circle as shown in phantom in FIG. 4. Thus, in the embodiment shown in FIG. 4, the recesses are disposed at the apices of an equilateral triangle. The center of the imaginary circle in FIG. 4 is the central axis of the valve assembly which is coincident with the axis of the load screw 22.

Figure 3:
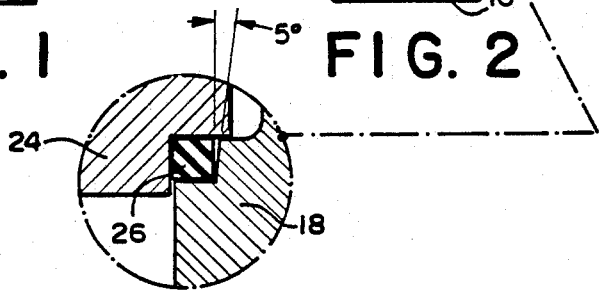
FIG. 3 is a section taken along 3—3 in FIG. 1.
Figure 3:
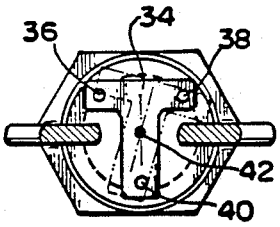

A like pattern of recesses is formed in the underside of a plate 34 by bores 36, 38, 40. As best seen in FIG. 3, plate 34 is preferably T-shaped, each of bores 36, 38, 40 being disposed at an extremity of the plate. Recess 42 is formed on the top side of the plate to receive the tip of the load screw 22 and, in the preferred embodiment described herein, is coincident with the central axis of the valve assembly.

A single thermal responsive element 44, in the form of a frangible glass bulb containing a heat expansive fluid, and a pair of rigid metal support pins 46, 48 are interposed between plate 34 and valve plug 24. The opposite ends of the thermal responsive element and support pins are seated in the valve plug recesses 28, 30, 32 and the plate recesses provided by bores 36, 38, 40. Thus, the outer diameters of the ends of the thermal responsive element and pins proximate the plate are slightly in excess of the bore diameters, and these ends of the thermal responsive element and support pins are tapered to seat in the bores. In the preferred embodiment, the thermal responsive element and support pins are equidistant and arranged in a triangular pattern, and the axial load on the thermal responsive element is therefore reduced by a factor of three. However, the support pins need not be equidistant, and by increasing the length of the moment arm between recess 40 (which receives bulb 44) and recess 42 (which receives the load screw 22) the axial load on the bulb can be reduced by as much as a factor of five. Accordingly, the thermal responsive element can be made thinner walled and therefore quicker acting.

Figure 5:
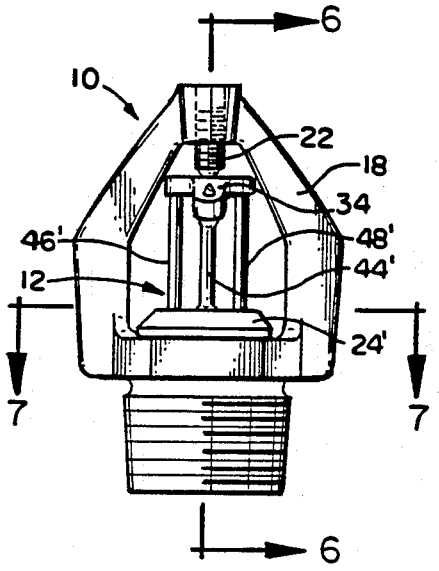
FIG. 5 is a side elevation of a second embodiment of a sprinkler having a valve assembly according to the present invention.
Figure 6:
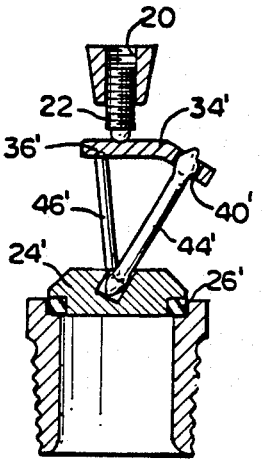
FIG. 6 is a section taken along 6—6 in FIG. 5.
Figure 7:
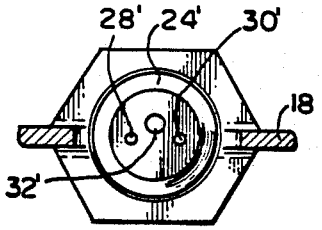
FIG. 7 is a section taken along 7—7 in FIG. 5.

In another embodiment of the present invention illustrated in FIGS. 5, 6 and 7, three recesses 28', 30', 32' in the valve plug 24, may be spaced along a line extending through or near the central axis of the valve assembly. Thus, in the embodiment shown in FIG. 6, the recesses are disposed substantially along an axis transverse to the central axis of the valve plug 24'. A pattern of recesses may be formed in the underside of a plate 34, as in FIG. 3 described above.

Where the recesses in the valve plug 24, are disposed substantially along an axis generally transverse to the central axis of the valve assembly, it would be understood in view of the present disclosure that the support pins 46', 48' and thermal responsive element 44' may be spaced apart by positioning the thermal responsive element 44' at an angle with respect to the support pins 46' and 48'. One skilled in the art will appreciate that it may be desired to form the plate 34' so that it is canted to receive the angled thermal responsive element 44' at a substantially perpendicular angle, as illustrated in FIG. 6.

Where the recesses in the valve plug 24', 28', 30', 32' are disposed substantially along an axis transverse to the central axis, the thermal responsive element 4', is preferably disposed at an angle of about 20° to about 60° and, more preferably, about 35° relative to the support pins 46', 48', although greater or lesser disposition angles may be used in accordance with the present invention.

Where the thermal responsive element 44' is disposed at an angle of about 35° relative to the support pins 46', 48', a load reduction on the thermal responsive element versus the support pins of about 13.8:1 is achieved. By lengthening or shortening the moment arm between recess 40' (which receives the thermal responsive element 44') and recess 42' (which receives load screw 22), the axial load on the thermal responsive element 44' can be further reduced or increased, respectively.

The present invention resides in the ability to retain load reduction in this manner substantially without thermal obtrusion of the thermal responsive element 44, 44' by the support pins. Thus, in the present invention, the thermal responsive element 44, 44' and support pins 46, 48 and 46', 48' are dimensioned and spaced apart such that a stream of ambient air directed at the sprinkler (for example, transverse to the valve assembly central axis) always impinges upon the thermal responsive element 44, 44' without obstruction by either of the support pins 46, 48 and 46', 48' regardless of the angular orientation of the valve assembly 12 with respect to the central axis of the assembly. Accordingly, should the valve assembly shift due to vibration or the like, it is not necessary to re-adjust the angular orientation of the valve assembly with respect to the assembly central axis. Angular displacement of the valve assembly 12 with respect to its central axis is shown for example by rotation of T-shaped plate 34 (phantom) in FIG. 3. Preferred dimensions of the thermal responsive element for the embodiment shown in FIGS. 1 through 4 are shown in Table 1 below. Preferred dimensions of the thermal responsive element for the embodiment shown in FIGS. 5 and 6 are shown in Table 2 below.

TABLE 1

| | Thermal Responsive Element | Support Pin | |
|---|---|---|---|
| | 44' | 46' | 48' |
| Outer Diameter | .100 inch | .125 inch | .125 inch |
| Length | .840 inch | .875 inch | .875 inch |

TABLE 2

| | Thermal Responsive Element | Support Pin | |
|---|---|---|---|
| | 44' | 46' | 48' |
| Outer Diameter | .100 inch | .125 inch | .125 inch |
| Length | .840 inch | .875 inch | .875 inch |

The support pins 46, 48 and 46', 48' may be dowel-like members, as illustrated in FIGS. 1, 2, 5 and 6 or, alternatively, ejector springs (not shown) may be used. It will be appreciated by those skilled in the art in view of this disclosure that dowel-like members or ejector springs may be used interchangeably as support pins in accordance with the present invention.

The present invention may be embodied in other specific forms without departing from the spirit or essential attributes thereof and, accordingly, reference should be made to the appended claims, rather than to the foregoing specification, as indicating the scope of the invention.

I claim:

1. A sprinkler including a body having a flow passage for a fire extinguishing fluid and a valve assembly axially loaded by an adjustable screw or the like to seal the flow passage, said valve assembly comprising:

a plate, a valve plug seated at an outlet end of the flow passage, a single thermal responsive element and two or more support pins extending between and seated at opposite ends thereof in said plate and valve plug, said thermal responsive element and support pins being spaced apart so as to reduce the axial load on said thermal responsive element substantially without thermal obtrusion of said thermal responsive element to an air stream by said support pins at substantially all angular orientations of said valve assembly with respect to a central axis of the valve assembly.

2. Sprinkler having a body including a flow passage for a fire extinguishing fluid and a valve assembly axially loaded by an adjustable screw or the like to seal the flow passage, said valve assembly comprising:

a plate having three or more recesses each disposed at an extremity thereof, a valve plug seated at an outlet end of the flow passage and having three or more recesses disposed in substantially the same pattern as the plate recesses, a single thermal responsive element and two or more support pins extending between and seated at opposite ends thereof in said plate and valve plug recesses, said thermal responsive element and support pins being spaced apart so as to reduce the axial load on said thermal responsive element substantially without thermal obtrusion of said thermal responsive element to an air stream by said support pins at substantially all angular orientations of said valve assembly with respect to a central axis of the valve assembly.

3. Sprinkler according to claim 1 or claim 2 wherein said thermal responsive element and support pins are spaced apart such that the axial load on said thermal responsive element is one-third the axial load on said plate.

4. Sprinkler according to claim 3 wherein said thermal responsive element and support pins are spaced apart such that the axial load on said thermal responsive element is one-fifth the axial load on said plate.

5. Sprinkler according to claim 1 or claim 2 including a resilient compressive seal axially interposed between a portion of said valve plug and a portion of said sprinkler body at the outlet of said flow passage.

6. Sprinkler according to claim 5 wherein said resilient compressive seal is an O-ring.

7. Sprinkler according to claim 1 or claim 2 wherein said thermal responsive element and support pin are located on an imaginary circle having a center at the central axis of the valve assembly.

8. A sprinkler comprising a body having a central axis, including a flow passage for a fire extinguishing fluid and a valve assembly axially loaded by an adjustable screw or the like to seal the flow passage, said valve assembly comprising:

a plate having three or more recesses, each disposed at an extremity thereof, a valve plug seated at an outlet end of the flow passage and having three or more recesses, each disposed at a point along an axis generally transverse to the central axis, a central thermal responsive element and two or more support pins extending between and seated at opposite ends thereof, in said plate and valve plug recesses, said thermal responsive element and support pins being spaced apart to reduce the axial load on said thermal responsive element substantially without thermal obtrusion of said thermal responsive element to an air stream by said support pins at substantially all angular orientations of said valve assembly with respect to the central axis of the sprinkler body.

9. Sprinkler according to claim 8 Wherein said thermal responsive element and support pins are spaced apart such that the axial load on said thermal responsive element is less than about one-sixth the axial load on said plate.

10. Sprinkler according to claim 8 wherein said thermal responsive element is disposed at an angle of about 20° to about 60° relative to said support pins.

11. Sprinkler according to claim 10 wherein said thermal responsive element is disposed at an angle of about 35° relative to said support pins.

12. Sprinkler according to claim 9 including a resilient compressive seal axially interposed between a portion of said valve plug and a portion of said sprinkler body at the outlet of said flow passage.

13. Sprinkler according to claim 12 wherein said resilient compressive seal is an O-ring.

* * * * *